US011377779B2

(12) United States Patent
Cavarretta et al.

(10) Patent No.: US 11,377,779 B2
(45) Date of Patent: Jul. 5, 2022

(54) METHOD FOR CONTROLLING A DRYING CYCLE OF A LAUNDRY DRYER

(71) Applicant: Electrolux Home Products Corporation N.V., Brussels (BE)

(72) Inventors: Francesco Cavarretta, Pordenone (IT); Elena Pesavento, Porcia (IT); Maurizio Ugel, Fiume Veneto (IT)

(73) Assignee: Electrolux Home Products Corporation N.V.

( * ) Notice: Subject to any disclaimer, the term of this patent is extended or adjusted under 35 U.S.C. 154(b) by 748 days.

(21) Appl. No.: 14/647,609

(22) PCT Filed: Nov. 20, 2013

(86) PCT No.: PCT/EP2013/074319
§ 371 (c)(1),
(2) Date: May 27, 2015

(87) PCT Pub. No.: WO2014/082909
PCT Pub. Date: Jun. 5, 2014

(65) Prior Publication Data

US 2015/0308035 A1 Oct. 29, 2015

(30) Foreign Application Priority Data

Nov. 28, 2012 (EP) ..... 12194562

(51) Int. Cl.
*D06F 58/38* (2020.01)
*D06F 103/10* (2020.01)
(Continued)

(52) U.S. Cl.
CPC ..... *D06F 58/38* (2020.02); *D06F 2101/20* (2020.02); *D06F 2103/04* (2020.02);
(Continued)

(58) Field of Classification Search
CPC ..... D06F 58/28; D06F 2058/2838; D06F 2058/2854; D06F 2058/2864; D06F 2058/2877; D06F 2058/2896
(Continued)

(56) References Cited

U.S. PATENT DOCUMENTS 6,557,382 B1 * 5/2003 Koike ..... D06F 39/007 68/13 A
9,777,428 B2 * 10/2017 Kim ..... D06F 58/28
(Continued)

FOREIGN PATENT DOCUMENTS

DE 2945696 A1 * 5/1981 ..... D06F 58/28
DE 2945696 A1 5/1981
(Continued)

OTHER PUBLICATIONS

International Search Report dated Apr. 8, 2014 in corresponding International Application No. PCT/EP2013/074319.

*Primary Examiner* — Jorge A Pereiro
*Assistant Examiner* — Logan P Jones
(74) *Attorney, Agent, or Firm* — RatnerPrestia

(57) ABSTRACT

A method is provided for controlling a drying cycle of a laundry dryer having a laundry drum and an air stream fan for circulating drying air through said laundry drum. The method includes the steps of: starting a drying cycle (14); performing the drying cycle (16); detecting an electric resistance and/or conductivity of the laundry during the drying cycle (16) for estimating a dryness level of the laundry; comparing the electric resistance and/or conductivity of the laundry with an end cycle condition (20; 28, 30; 36); and finishing the drying cycle (16), if the end cycle condition (20; 28, 30; 36) is fulfilled. The end cycle condi-
(Continued)

tion (20; 28, 30; 36) depends on the rotation speed ($S_D$) of the laundry drum and/or on the rotation speed ($S_F$) of the air stream fan.

6 Claims, 7 Drawing Sheets

(51) Int. Cl.

| | |
|---|---|
| *D06F 103/34* | (2020.01) |
| *D06F 103/36* | (2020.01) |
| *D06F 103/38* | (2020.01) |
| *D06F 103/44* | (2020.01) |
| *D06F 105/24* | (2020.01) |
| *D06F 105/46* | (2020.01) |
| *D06F 103/04* | (2020.01) |
| *D06F 103/32* | (2020.01) |
| *D06F 105/28* | (2020.01) |
| *D06F 105/32* | (2020.01) |
| *D06F 105/48* | (2020.01) |
| *D06F 101/20* | (2020.01) |

(52) U.S. Cl.
CPC ..... *D06F 2103/10* (2020.02); *D06F 2103/32* (2020.02); *D06F 2103/34* (2020.02); *D06F 2103/36* (2020.02); *D06F 2103/38* (2020.02); *D06F 2103/44* (2020.02); *D06F 2105/24* (2020.02); *D06F 2105/28* (2020.02); *D06F 2105/32* (2020.02); *D06F 2105/46* (2020.02); *D06F 2105/48* (2020.02)

(58) Field of Classification Search
USPC ..... 34/482
See application file for complete search history.

(56) References Cited

U.S. PATENT DOCUMENTS

| | | | | |
|---|---|---|---|---|
| 2004/0200093 | A1 | 10/2004 | Wunderlin et al. | |
| 2006/0242858 | A1* | 11/2006 | Beaulac | D06F 58/28 34/446 |
| 2007/0006601 | A1* | 1/2007 | Thiyagarajan | D06F 25/00 62/173 |
| 2007/0251118 | A1* | 11/2007 | Doh | D06F 58/28 34/528 |
| 2007/0256321 | A1* | 11/2007 | Bae | D06F 58/28 34/562 |
| 2010/0050703 | A1 | 3/2010 | Maekawa et al. | |
| 2011/0308103 | A1* | 12/2011 | Bellinger | D06F 58/28 34/497 |
| 2012/0317832 | A1* | 12/2012 | Lakkineni | D06F 58/20 34/477 |
| 2013/0019495 | A1* | 1/2013 | Colombo | D06F 58/203 34/491 |
| 2013/0047459 | A1* | 2/2013 | Geer | F26B 25/22 34/467 |

FOREIGN PATENT DOCUMENTS

| | | | | |
|---|---|---|---|---|
| EP | 1321563 | A2 | 6/2003 | |
| JP | 2012196393 | A | 10/2012 | |
| WO | 2008077969 | A1 | 7/2008 | |
| WO | WO 2012107280 | A2 * | 8/2012 | D06F 58/28 |

* cited by examiner

METHOD FOR CONTROLLING A DRYING CYCLE OF A LAUNDRY DRYER

BACKGROUND

The present invention relates to a method for controlling a drying cycle of a laundry dryer. Further, the present invention relates to a corresponding laundry dryer.

The rotation speed of a laundry drum in a laundry dryer is normally constant during the drying cycle. After selecting a program, the laundry drum starts to rotate at a set rotation speed and usually maintains the same rotation speed or a rotation speed very close to said set rotation speed till the cycle ends. During the drying cycle, a control unit of the laundry dryer analyses a dryness level signal and decides whether to end the drying cycle or not. The dryness level signal is estimated from the electric conductivity or the electric resistance of the laundry detected by a conductometric system. The conductimetric system includes two or more electrodes arranged so as to contact the clothes in the laundry drum.

FIG. 9 illustrates a flow chart diagram of the drying cycle according to the prior art. After starting 10 the laundry dryer, a user may select 12 the drying cycle and start 14 the selected drying cycle. During performing 16 the drying cycle, an end cycle condition 20 is periodically checked by the control unit of the laundry dryer. The end cycle condition 20 is fulfilled, if the dryness level of the laundry has achieved a predetermined value. If the end cycle condition 20 is not yet fulfilled, then the performing 16 of the drying cycle is continued. If the end cycle condition 20 is fulfilled, then final cycle actions are performed 22 and the drying cycle is finished 24.

SUMMARY OF SELECTED INVENTIVE ASPECTS

The applicant has found that the rotation speed of the laundry drum and/or air stream fan can further be used to optimize the drying performance. A variation of the rotation speed of the laundry drum can improve the drying performances and can reduce energy consumption.

However, the signal from the conductimetric system could be inaccurate at a varying rotation speed of the laundry drum and/or air stream fan, since the conductometric system is calibrated for a fixed rotation speed of the laundry drum and/or air stream fan. When the laundry drum is driven at low speed level or it is stopped and/or when the air stream fan generated the drying air flow rate is modified, then the contact between the electrodes of the conductometric system and the laundry to be dried changes. Thus, the signal from the conductometric system can be falsified, so that the drying cycle could be stopped at the wrong time.

It is an object of the present invention to provide a method for controlling a drying cycle in a laundry dryer, wherein said method uses a dryness level signal and allows variations of the rotation speed of the laundry drum and/or variations of the rotation speed of the air stream fan, without incurring in false detections of an end cycle condition and thereby avoiding a premature end of the drying cycle.

According to an aspect of the present invention, the method for controlling the drying cycle of a laundry dryer having a laundry drum and an air stream fan for circulating drying air through said laundry drum comprises the steps of:

starting a drying cycle, performing the drying cycle, detecting an electric resistance and/or conductivity of the laundry during the drying cycle for estimating a dryness level of the laundry, comparing the electric resistance and/or conductivity of the laundry with an end cycle condition, and finishing the drying cycle, if the end cycle condition is fulfilled, wherein the end cycle condition depends on the rotation speed of the laundry drum and/or on the rotation speed of the air stream fan.

The rotation speed of the laundry drum and/or the rotation speed of the air stream fan may be set according to the drying cycle selected by the user. For example, the rotation speed of the laundry drum for a specific drying cycle (for example depending on the textile to be dried) can be lower, e.g. 20-30 rpm, than the rotation speed of the laundry drum for a standard cycle, e.g. 55-65 rpm. In another case, a specific drying cycle can be provided so that the laundry drum can be stopped for a relatively long time interval, e.g. 3-10 minutes. For drying cycle selection is intended also the selection of optional functions such as an anti-crease phase, a steam laundry treatment phase with steam, a fast drying cycle, a low energy consumption drying cycle, a low noise drying cycle.

Preferably, the rotation speed of the laundry drum and/or the rotation speed of the air stream fan may be set and/or modified, during the drying cycle, according to an estimated amount of laundry contained in the laundry drum.

Laundry amount can be estimated by evaluating the fluctuations and/or noise of an electric signal representative of the resistivity and/or conductivity of the laundry. Further, electric or mechanical parameter of the motor driving the laundry drum are representative of the laundry amount.

Preferably, the rotation speed of the laundry drum and/or the rotation speed of the air stream fan may be set and/or modified, during the drying cycle, according to the laundry dryness level.

Preferably, the rotation speed of the laundry drum and/or the rotation speed of the air stream fan may be set and/or modified, during the drying cycle, according to the temperature of the air stream.

Preferably, at least one rotation speed condition of the laundry drum and/or the air stream fan may be checked during the drying cycle in order to select the corresponding end cycle condition from a plurality of end cycle conditions.

Preferably, at least one rotation speed condition of the laundry drum and/or the air stream fan may be checked during the drying cycle in order to modify an end cycle condition according to said rotation speed condition.

Preferably, a drying cycle is selected by a user before the start of the drying cycle. The rotation speed of the laundry drum is adapted to the selected drying cycle.

Preferably, at least two end cycle conditions are defined, wherein each end cycle condition is provided for a predetermined interval of the detected rotation speed of the laundry drum and/or air steam fan.

Preferably, the end cycle condition depends on at least one impedance threshold value.

Preferably, at least one resistance and/or conductivity threshold value is selected before the start of the drying cycle.

Preferably, at least one resistance and/or conductivity threshold value may be selected in dependence of the drying cycle or laundry dryness level.

Preferably, a first parameter relating to the rotation speed of the laundry drum may be selected during the drying cycle.

Preferably, a second parameter relating to the rotation speed of an air stream fan may be selected during the drying cycle.

Preferably, the end cycle condition depends on the first parameter and/or on the second parameter.

Preferably the motor driving the laundry drum and/or the motor driving the air stream fan is/are inverter motor.

According to another aspect of the present invention, provided is a method for controlling the drying cycle of a laundry dryer having a laundry drum, an air stream fan for circulating drying air through said laundry drum and an end cycle condition checking system based on the measurement of the electric resistance/conductivity of the laundry for determining whether an end of cycle condition is met, wherein the method comprises the steps of:

starting a drying cycle, performing the drying cycle, and disabling the end of cycle condition controller when the rotation speed of the laundry drum and/or the rotation speed of the air stream fan is/are below a predetermined lower threshold.

In contrast, the end cycle condition checking system is enabled when the rotation speed of the laundry drum and/or the rotation speed of the air stream fan is/are above a predetermined upper threshold.

For example, the predetermined lower threshold can be 15 rpm and the predetermined upper threshold can be 18 rpm. Preferably, the predetermined lower threshold and the predetermined upper threshold can coincide, e.g. 20 rpm, so that at 19.5 rpm the end cycle condition checking system is disabled and at 20.5 is enabled.

Preferably, the end cycle condition checking system comprises the steps of:

detecting the electric resistance and/or conductivity of the laundry, delivering at least one parameter based on the electric resistance and/or conductivity of the laundry to a control unit of the laundry dryer, comparing said parameter with a corresponding threshold value, and determining whether the end cycle condition is met.

Preferably, disabling of the end cycle condition checking system includes the step of disabling of at least one of the above steps.

Preferably, the end cycle condition is checked only, if the detected rotation speed of the laundry drum is at a speed level, at which the conductimetric system is calibrated. This avoids a false detection of the electric resistance or conductivity of the laundry by the conductimetric system.

The rotation speed of the laundry drum and/or the rotation speed of the air stream fan may be set according to the drying cycle selected by the user. For example, the rotation speed of the laundry drum for a specific drying cycle (for example depending on the textile to be dried) can be lower, e.g. 20-30 rpm, than the rotation speed of the laundry drum for a standard cycle, e.g. 55-65 rpm. In another case, a specific drying cycle can be provided so that the laundry drum can be stopped for a relatively long time interval, e.g. 3-10 minutes. For drying cycle selection is intended also the selection of optional functions such as an anti-crease phase, a steam laundry treatment phase with steam, a fast drying cycle, a low energy consumption drying cycle, a low noise drying cycle.

Preferably, the rotation speed of the laundry drum and/or the rotation speed of the air stream fan may be set and/or modified, during the drying cycle, according to an estimated amount of laundry contained in the laundry drum.

Laundry amount can be estimated by evaluating the fluctuations and/or noise of an electric signal representative of the resistivity and/or conductivity of the laundry. Further, electric or mechanical parameter of the motor driving the laundry drum are representative of the laundry amount.

Preferably, the rotation speed of the laundry drum and/or the rotation speed of the air stream fan may be set and/or modified, during the drying cycle, according to the laundry dryness level.

Preferably, the rotation speed of the laundry drum and/or the rotation speed of the air stream fan may be set and/or modified, during the drying cycle, according to the temperature of the air stream.

Preferably, a drying cycle is selected by a user before the start of the drying cycle. The rotation speed of the laundry drum is adapted to the selected drying cycle.

Preferably, the end cycle condition depends on the selected impedance threshold value.

According to a further embodiment of the present invention, an impedance threshold value is selected before the start of the drying cycle.

Preferably, at least one impedance threshold value may be selected in dependence of the selection of the drying cycle or laundry dryness level.

Preferably the motor driving the laundry drum and/or the motor driving the air stream fan is/are inverter motor.

At last, the present invention relates to a laundry dryer with a rotating laundry drum, wherein the laundry dryer is provided for the method mentioned above.

BRIEF DESCRIPTION OF THE DRAWINGS

The invention will be described in further detail with reference to the drawings, in which.

DETAILED DESCRIPTION OF EXAMPLE EMBODIMENTS

Figure 1:
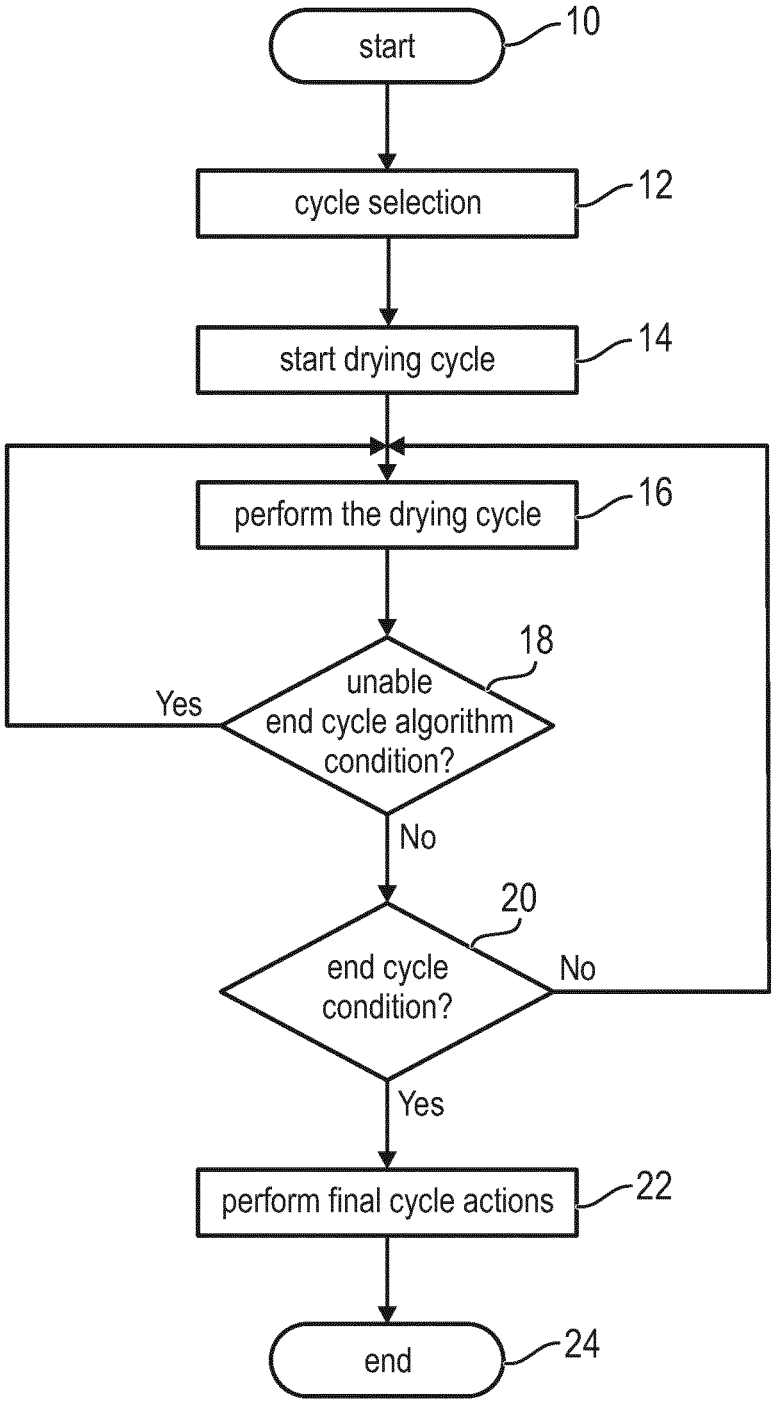
FIG. 1 illustrates a flow chart diagram of a drying cycle in a laundry dryer according to a first embodiment of the present invention.

FIG. 1 illustrates a flow chart diagram of a drying cycle in a laundry dryer according to a first embodiment of the present invention.

In the beginning the laundry dryer is started 10. For example, a user may start 10 the laundry dryer by actuating a power switch. Then, a cycle is selected 12 by the user. For example, the user may select 12 the cycle by actuating a selector switch or a push button. After the cycle has been selected 12, the drying cycle is started 14, for example, by actuating a start button, and performed 16.

During performing the drying cycle 16, a control unit of the laundry dryer analyses a dryness level signal and decides whether to end the drying cycle or not. The dryness level signal is estimated from the electric conductivity or the electric resistance of the laundry detected by a conductometric system. The conductometric system includes two or more electrodes adapted to contact the clothes in the laundry drum.

When the drying cycle is performed 16, the rotation speed of the laundry drum may be varied. The laundry drum may be driven at low speed level or may be stopped for a time or the air stream fan may be driven at different rotation speed, particularly at high or low speed. These variations may depend on the selection made by the user or on the clothes amount inside the laundry drum or on laundry dryness level over time or on the air stream temperature over time.

If a single motor drives both the laundry drum and an air stream fan, then the rotation speed $S_D$ of the laundry drum and the rotation speed $S_F$ of the air stream fan are proportional. The motor is usually directly connected to the air stream fan, while the laundry drum is connected to the motor via a belt pulley system.

In an alternative embodiment, a first motor is adapted to drive the laundry drum and a second motor is adapted to drive the air stream fan. In this case, also the speed variation of the air stream fan has been found to be relevant in modifying the contact between the electrodes of the conductimetric system and the clothes, thereby leading to false detections of an end cycle condition.

During the drying cycle 16 an unable end cycle algorithm condition 18 is checked. The unable end cycle algorithm condition 18 relates to a state, in which the laundry drum is driven below a set threshold level or stopped. Since the contacts between the electrodes of the conductimetric system and the laundry to be dried change significantly at a low speed level or in the stopped state of the laundry drum, or when the air stream fan speed is driven at lower or higher speed, the signal from the conductimetric system could be falsified. If the unable end cycle algorithm condition 18 is fulfilled, then the drying cycle is further performed 16. If the unable end cycle algorithm condition 18 is not fulfilled, then an end cycle condition 20 is checked. The unable end cycle algorithm condition 18 is not fulfilled, if the laundry drum and/or the air stream fan is/are driven at a standard speed level, at which the conductometric system is calibrated.

The user selects the drying cycle or a final clothes dryness level at the beginning of the cycle. The control unit matches this selection with a threshold of an electrical parameter detected by the conductimetric system. Said electrical parameter may be the electrical resistance or impedance or conductivity. During the drying cycle the conductimetric system detects the parameter via electrodes being in contact with the laundry during rotation of the laundry drum and sends the signal to the control unit. The control unit compares the signal with a corresponding threshold value and decides whether end cycle condition is met or the drying cycle is continued.

The laundry dryer includes an end cycle condition checking system comprising four main steps. The electrical parameter is detected by the conductometric system. Then, this parameter is acquired by the control unit. After that, the parameter is compared with the threshold value. At last, the control unit decides whether the end cycle procedure is started or not.

The end cycle condition checking system is disabled, if the rotation speed $S_D$ of the laundry drum and/or the rotation speed $S_F$ of the air stream fan are lower than the predetermined value. In this case, the sequence of the four main steps above is interrupted or modified, so that the end cycle condition checking system is disable, i.e. blind with respect to the dryness level reached by the laundry. For example, the decision of the control unit, whether the end cycle condition is met or not, may be skipped, so that no decision is taken and the drying cycle goes on independently of the signal by the conductometric system. In fact, the lower rotation speed $S_D$ of the laundry drum and/or the lower/higher rotation speed $S_F$ of the air stream fan may negatively affect the detection of the electric parameter.

Preferably, the end of cycle may be considered the time when the switching off the heating element of the laundry dryer is performed. Alternatively, the end of cycle may be considered the moment when a cooling phase is started or concluded in order to cool down the laundry, wherein the laundry drum and the air stream fan rotate for a predetermined time. Furthermore, the end of cycle may be considered the time when an anti-crease phase is started or concluded, wherein the anti-crease phase includes predetermined movements of the laundry drum in order to minimize the presence of wrinkles in the dried laundry.

When the end cycle condition 20 is checked, the laundry drum and/or the air stream fan is/are driven at the standard speed level, at which the conductimetric system is calibrated.

If the end cycle condition 20 is not fulfilled, then the drying cycle is further performed 16. If the end cycle condition 18 is fulfilled, then final cycle actions are performed 22, such as starting a cooling phase and/or starting an anti-crease phase and the drying cycle is finished 24. According to the first embodiment of the present invention, the end cycle condition 20 is checked only, if the laundry drum and/or the air stream fan is/are driven at the standard speed level, at which the conductometric system is calibrated. This avoids, that the drying cycle is stopped at the wrong time.

According to a second aspect of the present invention, the end cycle condition 36, 38 is calculated by the control unit according to specific parameters related to the rotation speed $S_D$ of the laundry drum and/or the rotation speed $S_F$ of the air stream (see FIG. 4) or a plurality of end cycle conditions 28, 30 are stored in a memory of the control unit and associated to specific rotation speeds $S_D$ of the laundry drum and/or the rotation speeds $S_F$ of the air stream fan. Corresponding ranges of rotation speed $S_D$ of the laundry drum and/or rotation speed $S_F$ of the air stream fan can be stored in a memory of the control unit. For example, said ranges are stored in a table, so that the control unit can select the specific parameters associated to the current rotation speed $S_D$ of the laundry drum and/or to the current rotation speed $S_F$ of the air stream fan, and calculate a modified end cycle condition according to the selected specific parameters. Similarly, for example, said ranges are stored in a table, so that the control unit can pick up the end cycle conditions 28, 30 corresponding to the rotation speed $S_D$ of the laundry drum and/or the rotation speed $S_F$ of the air stream fan and compare such end cycle conditions 28, 30 with the actual detected electric conductivity or electric resistance.

In a more sophisticated embodiment, a specific parameter or a specific end cycle condition can be provided for each rotation speed $S_D$ of the laundry drum and/or each rotation speed $S_F$ of the air stream in order to achieve a more precise control of the end cycle condition.

Figure 2:
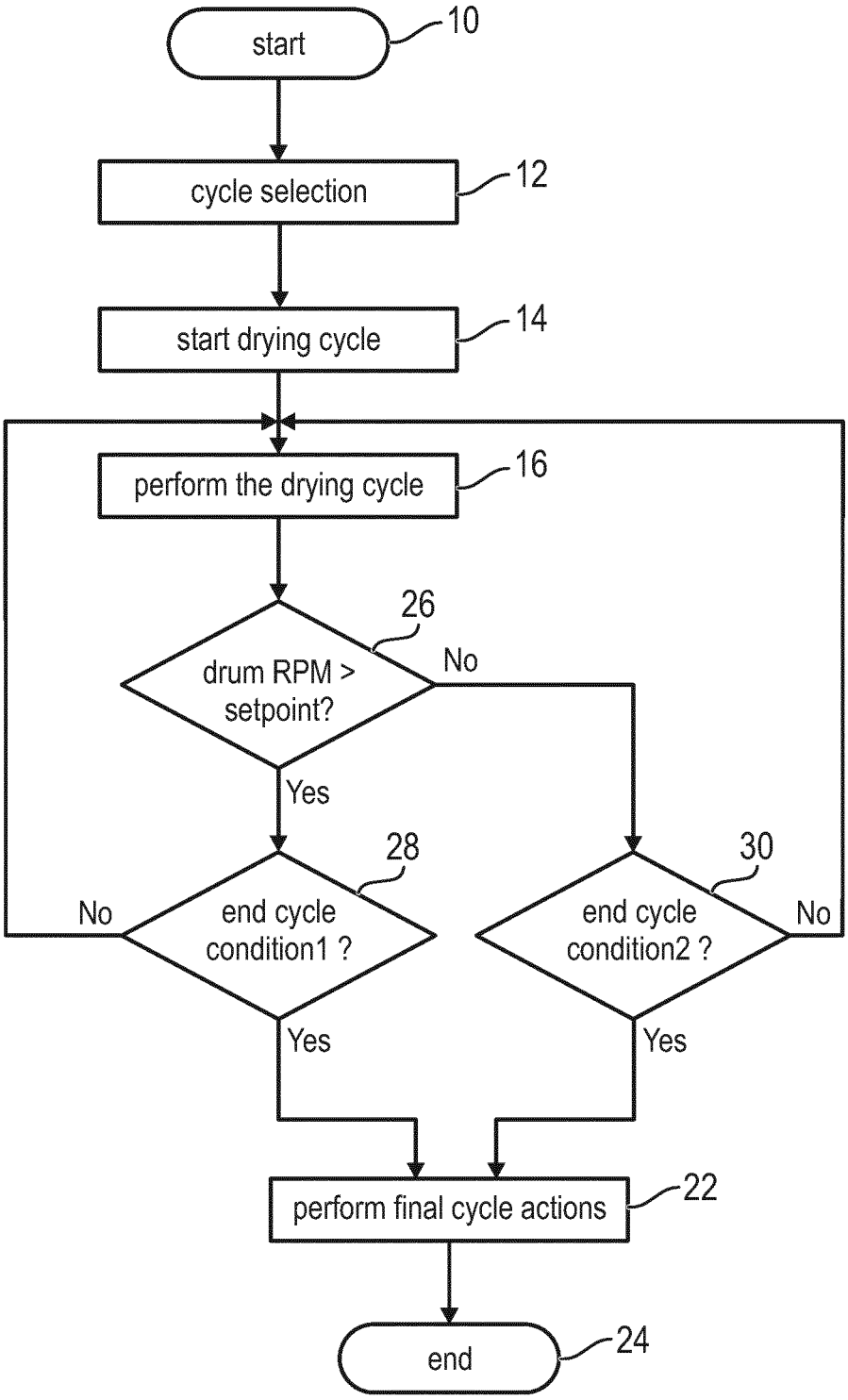
FIG. 2 illustrates a flow chart diagram of the drying cycle in the laundry dryer according to a second embodiment of the present invention.

FIG. 2 illustrates a flow chart diagram of the drying cycle in the laundry dryer according to a second embodiment of the present invention.

In the beginning the laundry dryer is started 10. For example, the user may start 10 the laundry dryer by actuating a m power switch or the like. Then, the cycle is selected 12 by the user. After the cycle has been selected 12, the drying cycle is started 14, for example, by actuating a start button, and performed 16.

During performing the drying cycle 16, the control unit of the laundry dryer analyses the dryness level signal and decides whether to end the drying cycle or not. The dryness level signal is estimated from the electric conductivity or the electric resistance of the laundry detected by the conductometric system.

When the drying cycle is performed 16, the rotation speed of the laundry drum is varied. The laundry drum may be driven at low speed level or may be stopped for a time.

During the drying cycle being performed 16, a rotation speed condition 26 is checked. In this example, it is checked, if the rotation speed of the laundry drum exceeds a predetermined set point value. If the rotation speed exceeds said predetermined set point value, then a first end cycle condition 28 is checked. If the rotation speed does not exceed the predetermined set point value, then a second end cycle condition 30 is checked.

If the first end cycle condition 28 or the second end cycle condition 30, respectively, is fulfilled, then the final cycle actions are performed 22 and the drying cycle is finished 24. If the first end cycle condition 28 or the second end cycle condition 30, respectively, is not fulfilled, then the drying cycle is further performed 16. The first end cycle condition 28 is calibrated for a rotation speed above the predetermined set point value. The second end cycle condition 28 is calibrated for a rotation speed below the predetermined set point value.

In general, more than two end cycle conditions may be defined, wherein each end cycle condition corresponds with one rotation speed interval of the laundry drum. In this case, the end cycle conditions are calibrated for rotation speeds within the corresponding rotation speed interval.

Figure 3:
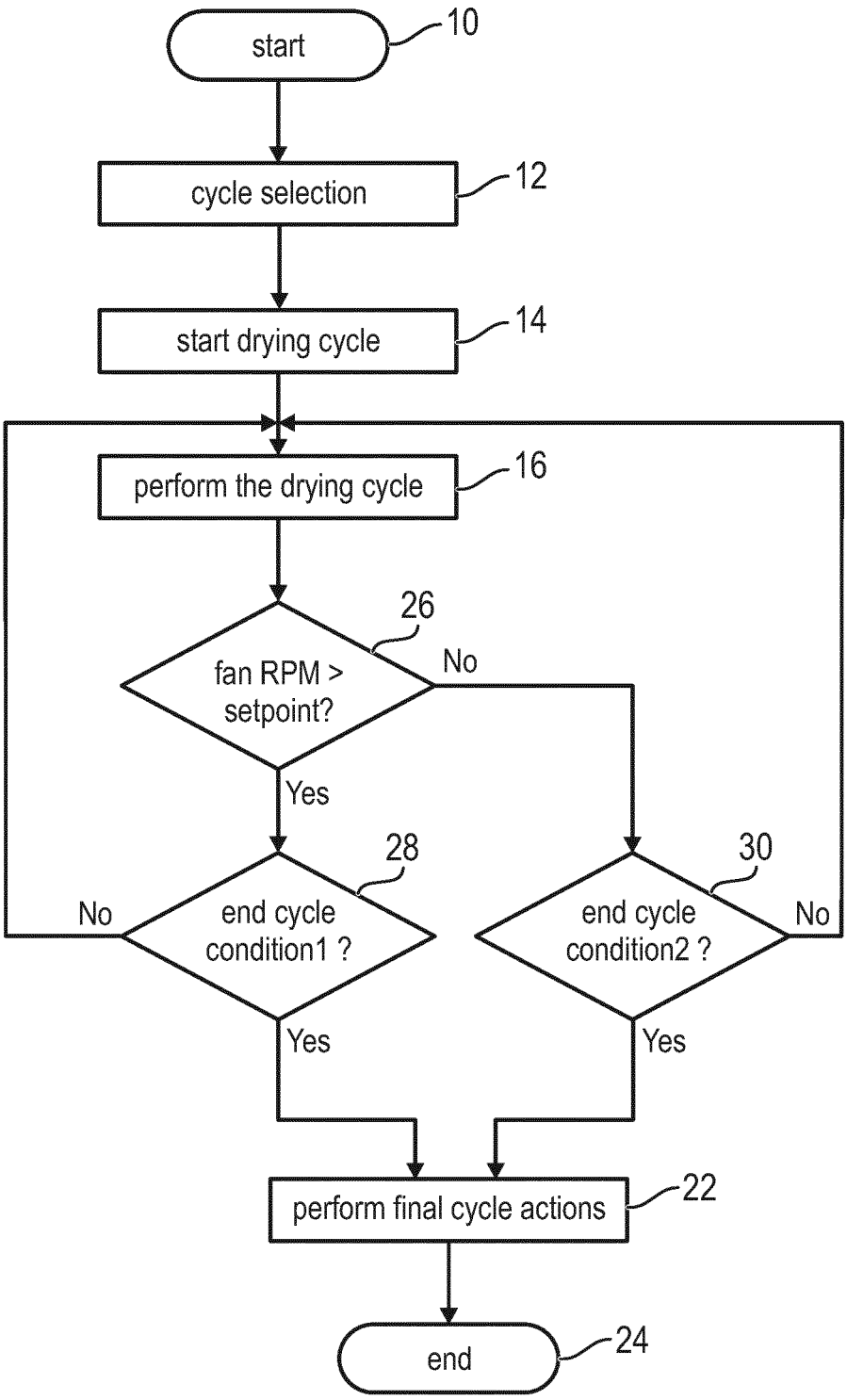
FIG. 3 illustrates a flow chart diagram of the drying cycle in the laundry dryer according to a third embodiment of the present invention.

FIG. 3 illustrates a flow chart diagram of the drying cycle in the laundry dryer according to a third embodiment of the present invention. The flow chart diagram in FIG. 3 is similar to the flow chart diagram in FIG. 2. The rotation speed condition 26 relates to the rotation speed $S_F$ of the air stream fan. The other steps are the same as in FIG. 2.

In case of a single motor for driving both the air stream fan and the laundry drum, the respective rotation speed are linked, however it has been found that it can be easier to check the rotation speed of the air stream fan than the rotation speed $S_D$ of the laundry drum, at least in some specific situations.

In case of a first motor to drive the laundry drum and a second motor to drive the air stream fan, it has been found that also the variation of the rotation speed $S_F$ of the air stream fan changes significantly the contacts between the electrodes and clothes inside the laundry dryer.

In a further embodiments, when the laundry dryer comprises a first motor to drive the laundry drum and a second motor to drive the air stream fan, the flow chart diagram of FIGS. 2 and 3 can be combined in order to accurately determine the end cycle conditions according to the rotation speed $S_D$ of the laundry drum and the rotation speed $S_F$ of the air stream fan, which are independent of each other.

Figure 4:
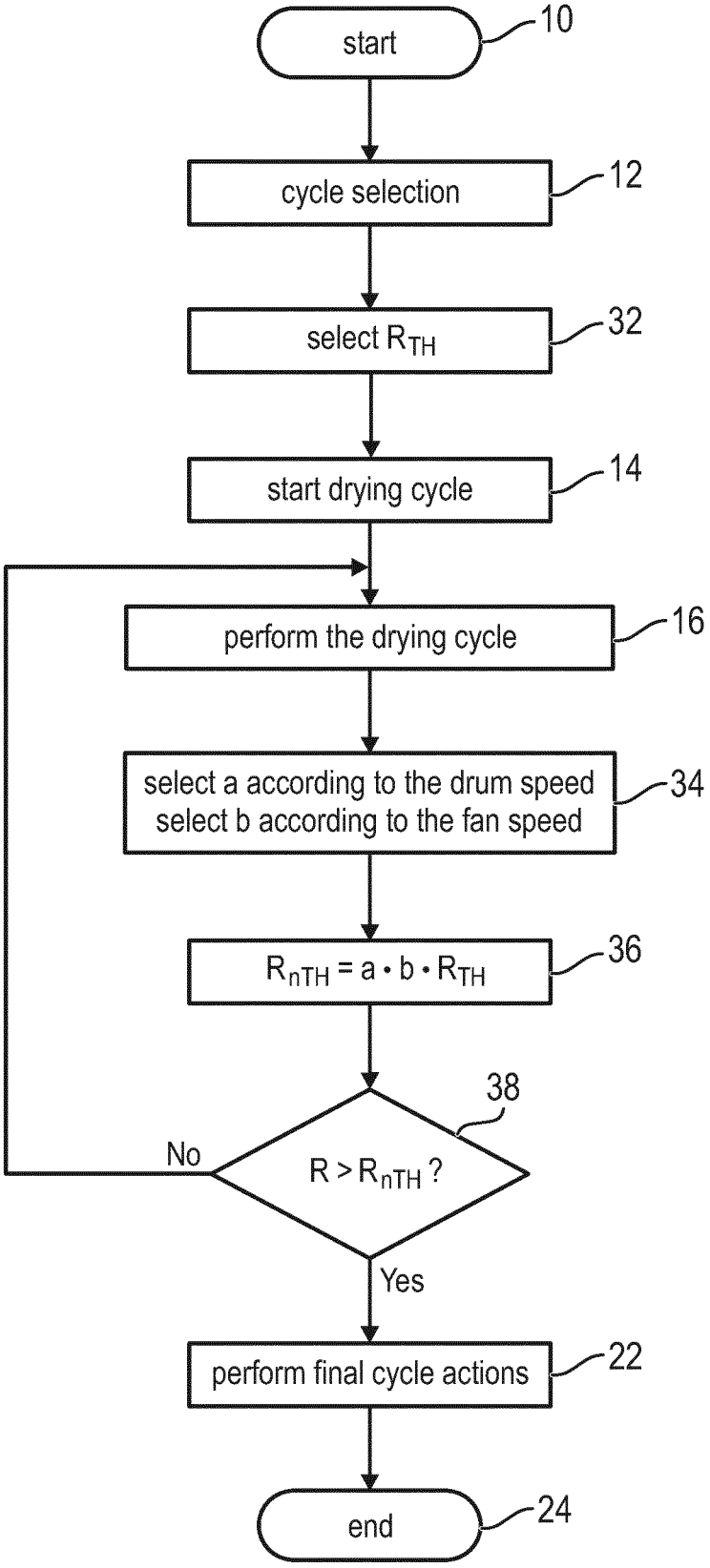
FIG. 4 illustrates a flow chart diagram of the drying cycle in the laundry dryer according to a fourth embodiment of the present invention.

FIG. 4 illustrates a flow chart diagram of the drying cycle in the laundry dryer according to a fourth embodiment of the present invention. In particular, the drying cycle of the fourth embodiment is particularly suitable for a laundry dryer with a drum motor for driving the laundry drum and a fan motor for driving an air stream fan.

In the beginning the laundry dryer is started 10. Then, the cycle is selected 12 by the user. Further, a predefined end-of-cycle condition 32 is activated, preferably depending on the drying cycle selected by the user. In this example, an impedance threshold value $R_{TH}$ is directly or indirectly selected by the user. After the end-of-cycle condition 32 has been selected, the drying cycle is started 14 and performed 16.

During performing the drying cycle 16, the control unit of the laundry dryer analyses the dryness level signal and decides whether to end the drying cycle or not. The dryness level signal is estimated from the electric conductivity or the electric resistance of the laundry detected by the conductometric system. When the drying cycle is performed 16, the rotation speed of the laundry drum and/or of the air steam fan is varied. The laundry drum may be driven at low speed level or may be stopped for a time and/or the air stream fan can be driven at high/low speed.

During performing the drying cycle 16, a step for selecting parameters 34 relating to the drum motor and fan is provided. A first parameter a relates to the rotation speed $S_D$ of the laundry drum. A second parameter b relates to the rotation speed $S_F$ of the air stream fan. As next step 36 a modified impedance threshold value $R_{nTH}$ is estimated. The modified impedance threshold value $R_{nTH}$ depends on the impedance threshold value $R_{TH}$, the rotation speed $S_D$ of the laundry drum and the rotation speed $S_F$ of the air fan stream:

$$R_{nTH}=f(R_{TH},S_D,S_F).$$

According to a simple implementation, the modified impedance threshold value $R_{nTH}$, i.e. the modified end cycle condition, is a linear function of the parameters a and b and the impedance threshold value $R_{TH}$:

$$R_{nTH}=a\cdot b\cdot R_{TH}.$$

For example, the parameters a and b lie in an interval [0,2] and have the value a=b=1, if both the rotation speed $S_D$ of the laundry drum and the rotation speed $S_F$ of the air fan stream are at values, for which the modified end cycle condition 38 coincides with the predefined end cycle condition.

Said modified end cycle condition 38 is checked as next step. If an impedance R detected by the conductometric system exceeds the modified impedance threshold value $R_{nTH}$, then the final cycle actions are performed 22 and the drying cycle is finished 24. If the impedance R detected by the conductometric system is below the modified impedance threshold value $R_{nTH}$, then the drying cycle is further performed 16.

Figure 5:
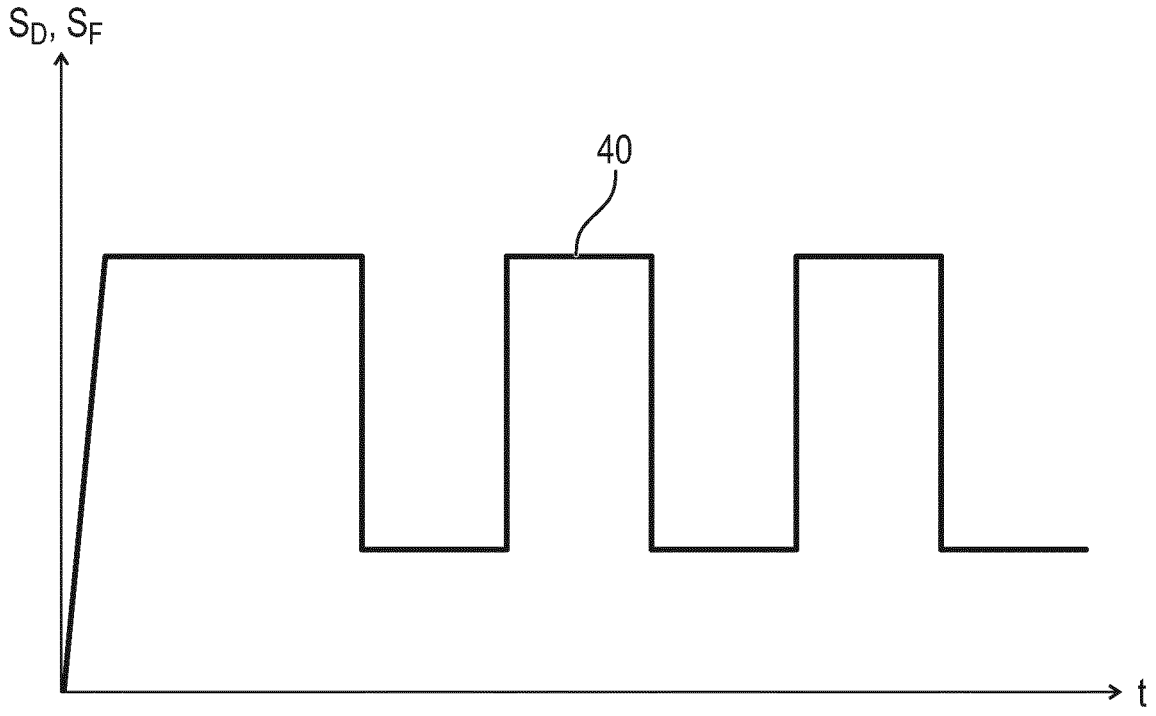
FIG. 5 illustrates a diagram of a rotation speed pattern of the laundry dryer according to an example of the present invention.

FIG. 5 illustrates a diagram of a rotation speed pattern 40 of the laundry dryer according to an example of the present invention. The rotation speed pattern 40 relates to the rotation speed $S_D$ of the laundry drum. If a single motor drives both the laundry drum and the air stream fan, then the rotation speed pattern 40 relates to the rotation speed $S_D$ of the laundry drum or to the rotation speed $S_F$ of the air fan stream.

The rotation speed pattern 40 is defined by the drying cycle selected by the user. In this case, the control unit drives the motor or the motors, respectively, so as to change the rotation speed $S_D$ of the laundry drum and the rotation speed $S_F$ of the air fan stream according to the predetermined rotation speed pattern 40, wherein the control unit disables the end cycle condition checking system according to the a specific speed of laundry drum and/or the air stream.

Figure 6:
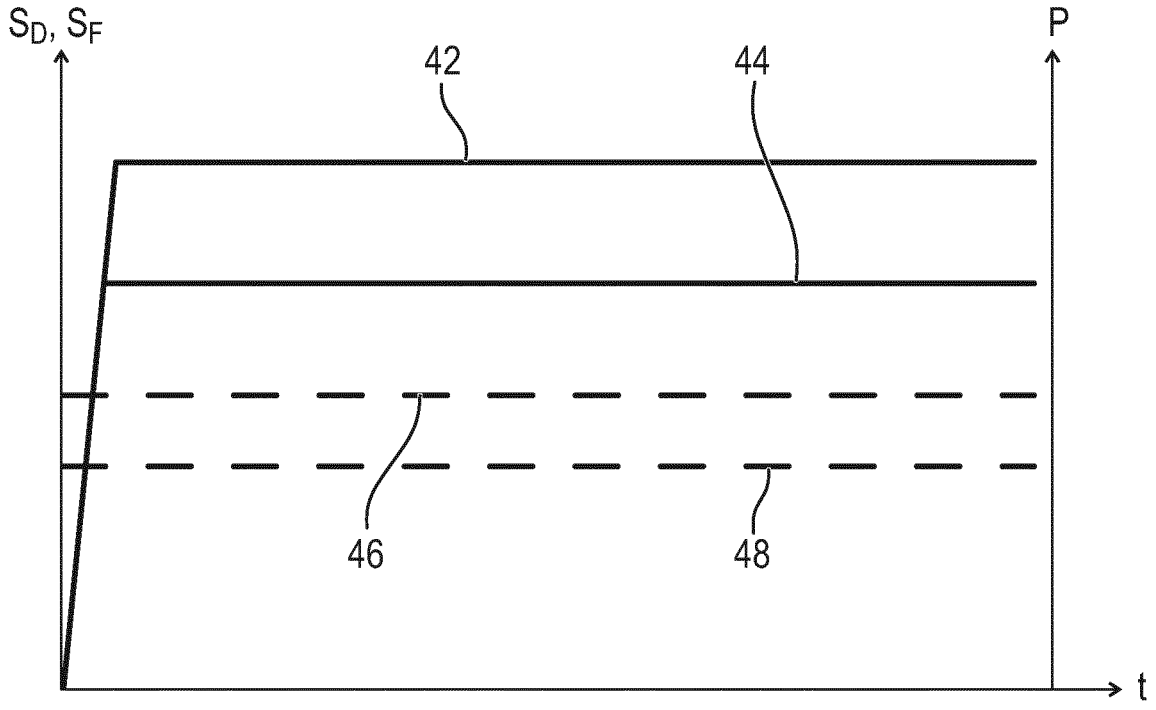
FIG. 6 illustrates diagrams of two rotation speeds and two corresponding threshold values of the laundry dryer according to another example of the present invention.

FIG. 6 illustrates diagrams of two rotation speeds 42 and 44 particularly of the laundry drum and two corresponding threshold values 46 and 48 of the end cycle condition according to another example of the present invention. FIG. 6 shows a high level rotation speed 42 and a low level rotation speed 44. A high threshold value 46 corresponds with the high level rotation speed 42. A low threshold value 48 corresponds with the low level rotation speed 44. The threshold values 46 and 48 corresponds to different end cycle conditions to which the electric parameter P detected by the conductimetric system are to be compared.

Figure 7:
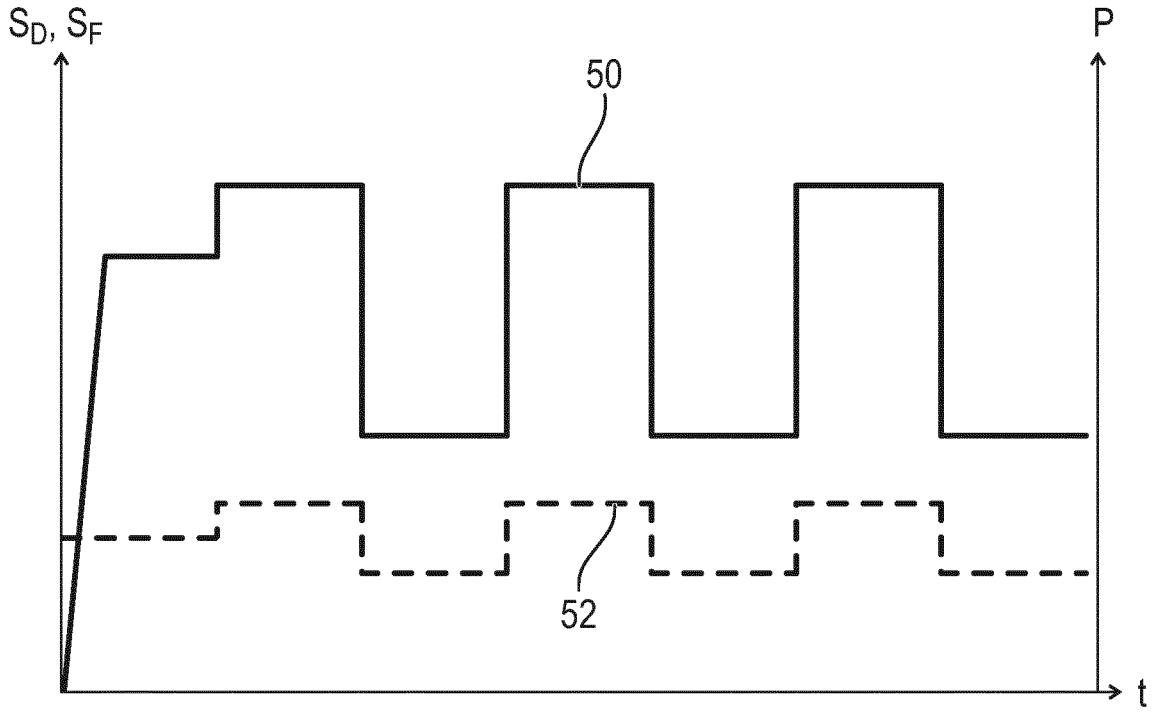
FIG. 7 illustrates diagrams of the rotation speed pattern and a corresponding threshold pattern of the laundry dryer according to a further example of the present invention.

FIG. 7 illustrates diagrams of a rotation speed pattern 50 and a corresponding threshold pattern 52 of the end cycle condition according to a further example of the present invention. The rotation speed pattern 54 is similar as in FIG. 5. The threshold pattern 52 has the same structure as the rotation speed pattern 54. A high rotation speed value corresponds with a high threshold value. In a similar way, a low rotation speed value corresponds with a low threshold value. The threshold pattern 52 corresponds to different end cycle conditions to which the electric parameter P detected by the conductimetric system are to be compared.

Figure 8:
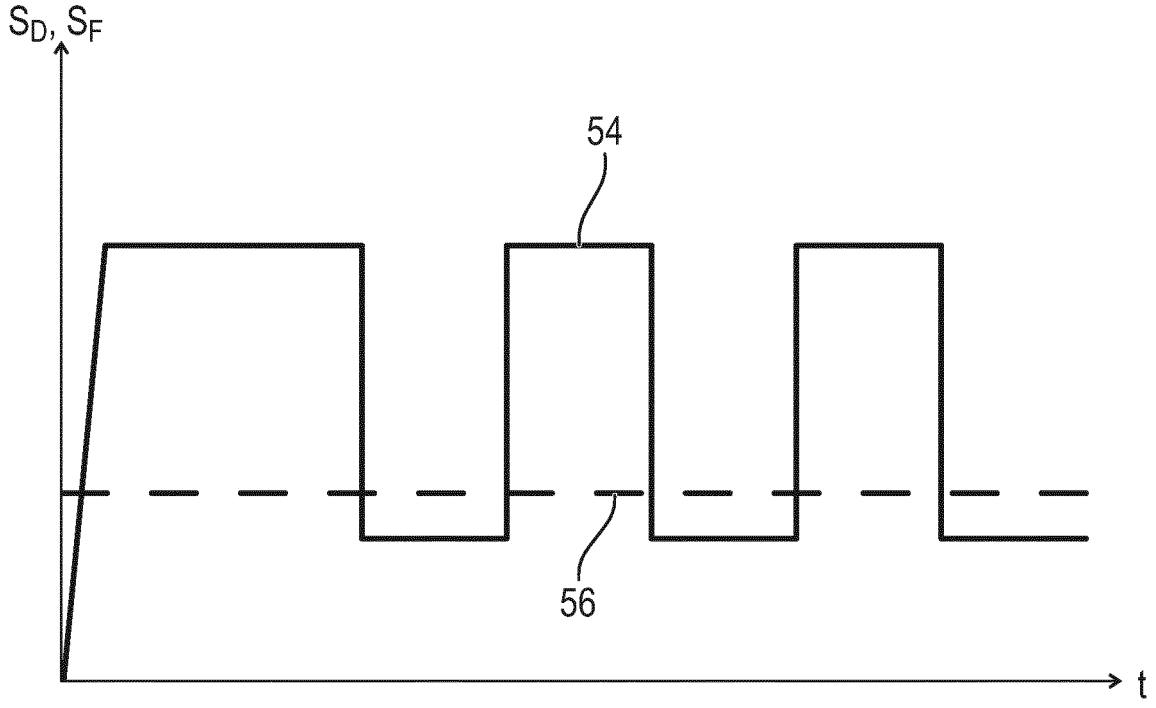
FIG. 8 illustrates diagrams of the rotation speed pattern and the corresponding threshold value of the laundry dryer according to a further example of the present invention.

FIG. 8 illustrates diagrams of a rotation speed pattern 54 and a corresponding threshold speed 56 according to a further example of the present invention. The rotation speed pattern 54 is similar as in FIG. 5. The threshold speed 56 relates to the rotation speed $S_D$ of the laundry drum and/or the rotation speed $S_F$ of the air stream fan below which the end cycle condition checking system is disabled.

Figure 9:
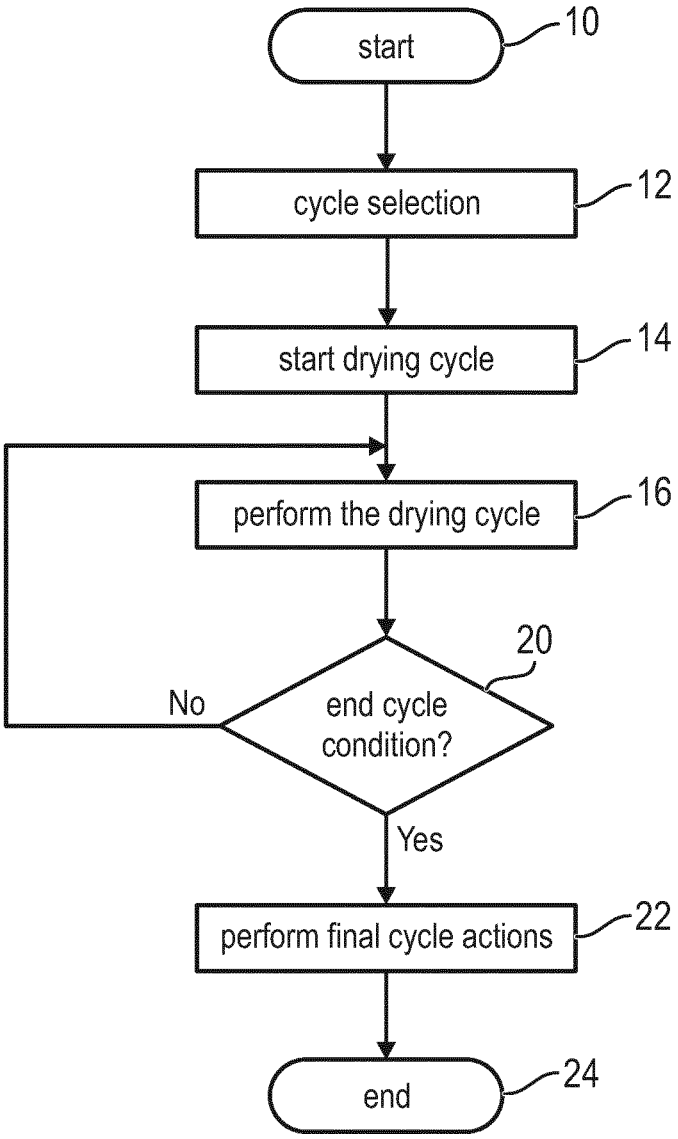
FIG. 9 illustrates a flow chart diagram of the drying cycle in the laundry dryer according to the prior art.

FIG. 9 illustrates a flow chart diagram of the drying cycle according to the prior art. After starting 10 the laundry dryer, the user may select 12 the drying cycle and start 14 the selected drying cycle. During performing 16 the drying cycle, the end cycle condition 20 is periodically checked by the control unit of the laundry dryer. The end cycle condition 20 is fulfilled, if the dryness level of the laundry has achieved a predetermined value. If the end cycle condition 20 is not yet fulfilled, then the performing 16 of the drying cycle is continued. If the end cycle condition 20 is fulfilled, then final cycle actions are performed 22 and the drying cycle is finished 24.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

LIST OF REFERENCE NUMERALS

10 step of starting the laundry dryer
12 step of cycle selection
14 step of starting the drying cycle
16 step of performing the drying cycle
18 unable end cycle algorithm condition
20 end cycle condition
22 step of performing final cycle actions
24 step of finishing the drying cycle
26 rotation speed condition
28 first end cycle condition
30 second end cycle condition
32 step of selecting an impedance threshold value
34 step of selecting parameters
36 step of modifying the impedance threshold value
38 modified end cycle condition
40 rotation speed pattern
42 high level rotation speed
44 low level rotation speed
46 high threshold value
48 low threshold value
50 rotation speed pattern
52 threshold pattern
54 rotation speed pattern
56 threshold value
P electrical parameter
R impedance
$R_{TH}$ impedance threshold value
$R_{nTH}$ modified impedance threshold value
a first parameter
b second parameter
$S_D$ rotation speed of the laundry drum
$S_F$ rotation speed of the air stream fan

The invention claimed is:

1. A method for controlling a drying cycle of a laundry dryer having a laundry drum and an air stream fan for circulating drying air through said laundry drum, the method comprises the steps of:

starting a drying cycle having an initial end cycle condition, starting the drying cycle at a rotation speed (SD) of a laundry drum, and a rotation speed (SF) of the air stream fan, estimating an amount of laundry contained in the laundry drum, modifying the rotation speed (SD) of the laundry drum and/or the rotation speed (SF) of the air stream fan, during the drying cycle, according to an estimated amount of laundry contained in the laundry drum, a laundry dryness level, or a temperature of the air stream, evaluating a modified rotation speed (SD) of the laundry drum and/or a modified rotation speed (SF) of the air stream fan, and, based upon such evaluation, modifying the initial end cycle condition to be a modified end cycle condition, detecting an electric resistance and/or conductivity of the laundry during the drying cycle for estimating a dryness level of the laundry, comparing the electric resistance and/or conductivity of the laundry with the modified end cycle condition, and finishing the drying cycle after the modified end cycle condition is fulfilled.

2. The method according to claim 1, wherein the drying cycle is selected by a user before the start of the drying cycle and the rotation speed (SD) of the laundry drum is adapted to the selected drying cycle.

3. The method according to claim 1, wherein the end cycle condition depends on at least one resistance and/or conductivity threshold value (RTH).

4. The method according to claim 1, wherein a resistance and/or conductivity threshold value (RTH) is selected before the start of the drying cycle.

5. The method according to claim 1, wherein at least one resistance and/or conductivity threshold value (RTH) is selected in dependence of the drying cycle or the laundry dryness level.

6. The method according to claim 1, wherein the motor driving the laundry drum and/or the motor driving the air stream fan is an inverter motor.

* * * * *